US006626265B1

(12) United States Patent
Devine

(10) Patent No.: US 6,626,265 B1
(45) Date of Patent: Sep. 30, 2003

(54) CONTROLLED DESCENT APPARATUS

(75) Inventor: Millard J. Devine, Rockford, IL (US)

(73) Assignee: FIDS, Inc., Rockford, IL (US)

( * ) Notice: Subject to any disclaimer, the term of this patent is extended or adjusted under 35 U.S.C. 154(b) by 0 days.

(21) Appl. No.: 09/896,976

(22) Filed: Jun. 29, 2001

(51) Int. Cl.[7] ..... A62B 1/12
(52) U.S. Cl. ..... 182/238; 182/71
(58) Field of Search ..... 182/238, 71, 233, 182/234, 239

(56) References Cited

U.S. PATENT DOCUMENTS

| | | | | |
|---|---|---|---|---|
| 287,492 A | | 10/1883 | Woodward | |
| 526,385 A | | 9/1894 | Dymacek | |
| 652,247 A | | 6/1900 | Christ | |
| 701,094 A | | 5/1902 | Setbacken | |
| 3,261,590 A | * | 7/1966 | Beech | |
| 3,834,671 A | | 9/1974 | Du Mesnil du Buisson | 254/158 |
| 3,844,377 A | | 10/1974 | Wilkins | 182/6 |
| 3,861,496 A | | 1/1975 | Hoover | 182/5 |
| 3,879,016 A | | 4/1975 | Kankkunen | 254/158 |
| 3,880,255 A | | 4/1975 | Huntley | 182/5 |
| 3,915,432 A | | 10/1975 | Bustamante | 254/157 |
| 4,018,423 A | | 4/1977 | Belew | 254/158 |
| 4,026,385 A | | 5/1977 | Murukurthy | 182/75 |
| 4,442,918 A | | 4/1984 | Rhoads, Sr. | |
| 4,473,160 A | * | 9/1984 | Neuenschwander | |
| 4,493,396 A | | 1/1985 | Borgia | 182/238 |
| 4,520,900 A | | 6/1985 | Orgeron | 182/238 |
| 4,550,801 A | | 11/1985 | Forrest | 182/7 |
| 4,616,735 A | * | 10/1986 | Orgeron | 182/238 |
| 4,653,609 A | * | 3/1987 | Devine | 182/238 |
| 5,586,617 A | | 12/1996 | England et al. | 182/238 |
| 5,762,282 A | | 6/1998 | Wolner | 242/390.8 |

FOREIGN PATENT DOCUMENTS

| | | |
|---|---|---|
| DE | 2 306 110 | 2/1973 |
| DE | 2 326 041 | 5/1973 |

* cited by examiner

*Primary Examiner*—Alvin Chin-Shue
(74) *Attorney, Agent, or Firm*—Leydig, Voit & Mayer, Ltd.

(57) ABSTRACT

A controlled descent apparatus includes a cable which is wound on a spool and is unwound from the spool by the weight of a person to effect the descent. To limit the rate of descent, the spool turns as the cable is unwound and drives a positive displacement pump the output of which is through a flow control valve. A secondary braking system is designed to provide a smooth transition between the systems. The cable is guided through an opening, such as a window, by an arm which is formed by inner and outer sections pivotally connected to each other with the inner arm pivotally connected relative to the wall so that the arm may be placed in a compact stored condition. The release of a latch permits the arm to self-deploy into an active position.

9 Claims, 13 Drawing Sheets

20
30
32
56
84
88
86
81
163
82
162
50
64
70
161
92
66
60
164
166
165
150
116
96
160
94
98
32

20
30
32
87
88
85
86
86
64
50
54
60
66
168
169
34
96
98
95
32
97

CONTROLLED DESCENT APPARATUS

FIELD OF THE INVENTION

The present invention relates generally to escape devices, and more particularly relates to escape devices for high-rise buildings.

BACKGROUND OF THE INVENTION

In case of emergencies such as fire in tall apartment buildings, hotels, office buildings and the like, conventional means of escape such as stairs and ladders may be impractical or impossible to use. This invention relates to an apparatus which permits an object, usually a person, to be lowered from an elevated place in such a building at a controlled and safe rate of descent.

Prior controlled descent devices, such as that disclosed in Devine, U.S. Pat. No. 4,653,609, the disclosure of which is hereby incorporated by reference in its entirety, may be mounted to the interior of a building, and can lower persons along the exterior of the building at a controlled rate for safe descent. While such systems have enjoyed much success, there are some drawbacks. For example, the apparatuses are generally very large and heavy. This bulk makes transporting the apparatus difficult, especially mounting the apparatus to a building's interior walls. Similarly, the walls must have the strength and load bearing capacity to support the descent apparatus off the ground. These descent apparatuses also typically require the user to manually manipulate the arm so that it extends through an opening in the building for egress.

Many descent apparatuses also include a backup braking system in the event the main system fails. Unfortunately, the transition between the main system and the backup system is not very smooth, and can be uncomfortable to the user of the device. During transition, the rate of descent can quickly increase or decrease as the back-up system takes over, resulting in a jerky transition that does not provide a smooth descent for the user or object.

SUMMARY OF THE INVENTION

In light of the foregoing, the general object of the invention is to provide a novel controlled descent apparatus that is light weight and compact.

It is also an object of the present invention to provide a descent apparatus having and arm for guiding the cable to the exterior of a building for descent, the arm being self-deploying.

It is a further object of the present invention to provide a descent apparatus having smooth and safe transition between the main braking system and the backup braking system.

In accordance with these objects, the present invention provides a novel descent apparatus comprising a frame adapted to be mounted to building adjacent an opening in the wall, and an arm rotatable between a stored position generally within the frame and an active position projecting a free end through the opening in the wall. A supply of cable is stored on a spool rotatably connected to the frame, the cable guided to a pulley proximate the free end of the arm whereby a weight attached to the cable beyond the pulley will descend while drawing cable from the supply. A hydraulic circuit is operatively connected to the spool to control the rate at which the cable is drawn from the supply.

According to an aspect of the present invention to construct the apparatus is constructed in a compact nature to reduce the size and weight, thus making mobility and mounting easier. Preferably, the hydraulic circuit includes a positive displacement pump mounted on the frame, a first reservoir connected to a pump inlet and a second reservoir connected to a pump outlet, a flow control valve connected to the pump outlet to limit flow of fluid through the outlet to a preselected rate. Preferably, the first and second reservoirs are integrally formed with the frame to provide a lightweight and compact apparatus. Most preferably, third and second reservoirs are associated with a second hydraulic circuit and are also integrally formed with the frame. Preferably, the frame and arm are constructed of aluminum. It has been found the aluminum has sufficient strength characteristics for supporting the apparatus and any weight placed on the end of the cable, such as a person. Furthermore, aluminum is significantly lighter than previously used metals, allowing the compact apparatus to be more easily moved and mounted.

According to another aspect of the invention, the arm is self-deploying, wherein the arm moves from an inactive position to an active position under its own weight. Preferably, the arm includes an inner section and an outer section, and a first bushing pivotally connects the outer section to the inner section. A second bushing pivotally connects the inner section to the frame, and the outer section rotates about the first bushing faster than the inner section rotates about the second bushing as the arm rotates from the stored position to the active position. This provides a self-deploying arm which quickly and easily moves from a stored position to an active position.

According to yet another aspect of the invention, a second hydraulic circuit is operatively connected to the spool and includes a second positive displacement pump mounted on the frame, a third reservoir connected to a pump inlet and a fourth reservoir connected to a pump outlet, a second flow control valve connected to the pump outlet to limit flow of fluid through the second hydraulic circuit to a rate either identical to or slightly higher than the first hydraulic circuit to control the rate at which the cable is drawn from the supply when the spool turns at a speed faster than permitted by the first hydraulic circuit. The first and second hydraulic circuits are closely regulated to provide a smooth and preferably immediate transition between the transfer of control from one circuit to the other.

These and other object and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
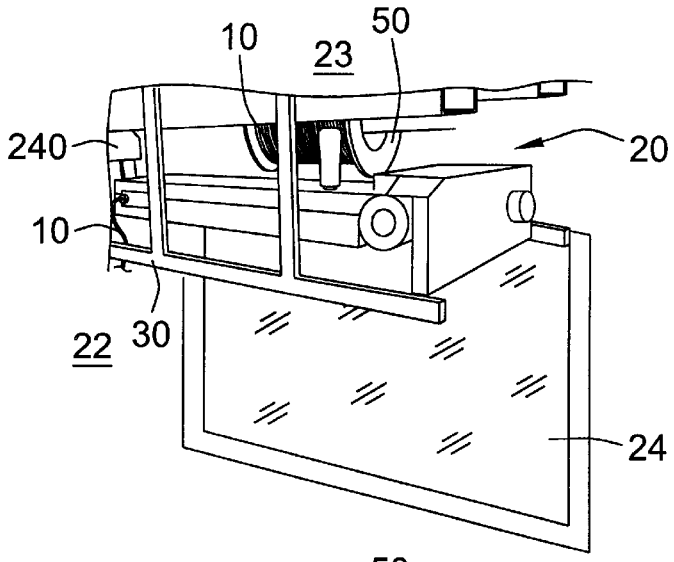
FIG. 1 illustrates a perspective view of a preferred embodiment of the controlled descent apparatus according to the present invention.
Figure 2:
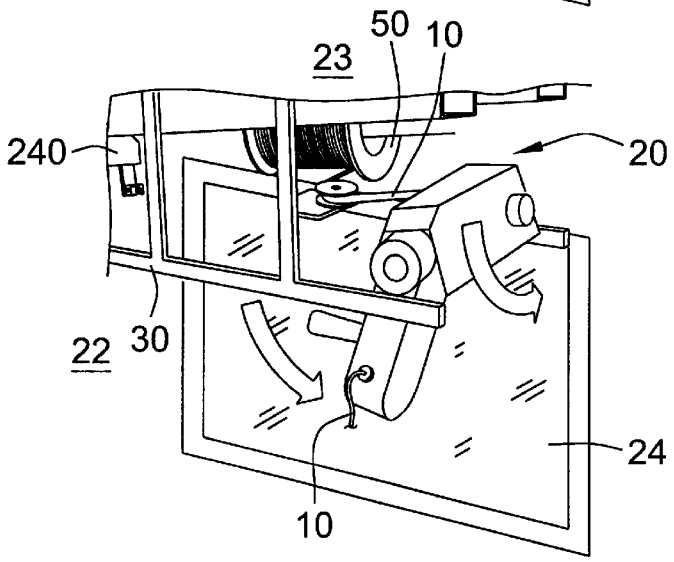
FIG. 2 illustrates the arm of the descent apparatus of FIG. 1 rotating to an active position.
Figure 3:
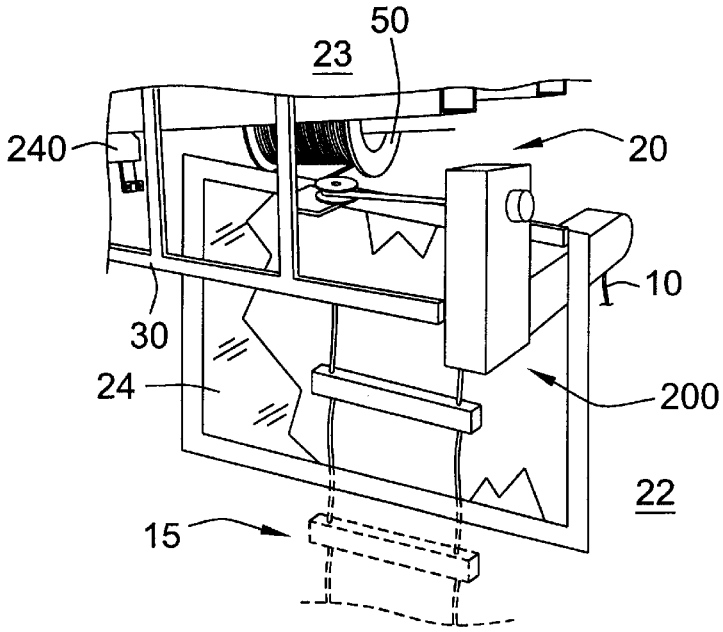
FIG. 3 illustrates the arm of the descent apparatus of FIG. 1 in the active position.

As shown in the drawings for purposes of illustration, the invention is embodied in an apparatus for lowering an object, usually a person, from some elevated place in the event of an emergency. For example, in case of fire in a tall apartment building, hotel or office building, the only escape may be through a window and it may be impractical or impossible to use a ladder for this. Accordingly, the present invention contemplates the provision of a novel apparatus by which the person is lowered automatically by gravity by virtue of his own weight and the lowering occurs at a controlled rate of descent. As generally illustrated in FIGS. 1–3, which is partially cut-away and has elements removed, the descent apparatus 20 includes a cable 10 wound on a spool 50 with the person or object carried by the free end of the cable so that the weight of the person turns the spool 50 and unwinds the cable and a control means limits the rotation of the spool to a preselected maximum speed and thus limits the rate at which the person descends. The invention also contemplates the provision of a novel arm 200 which is stored inside the building but is movable through an opening such as a window 24 to project outside and guide the cable 10 outside for the descent. As will be seen in the description below, the apparatus 20 does not require a power source for descent or ascent, but will use a power source on ascent if available.

Figure 4:
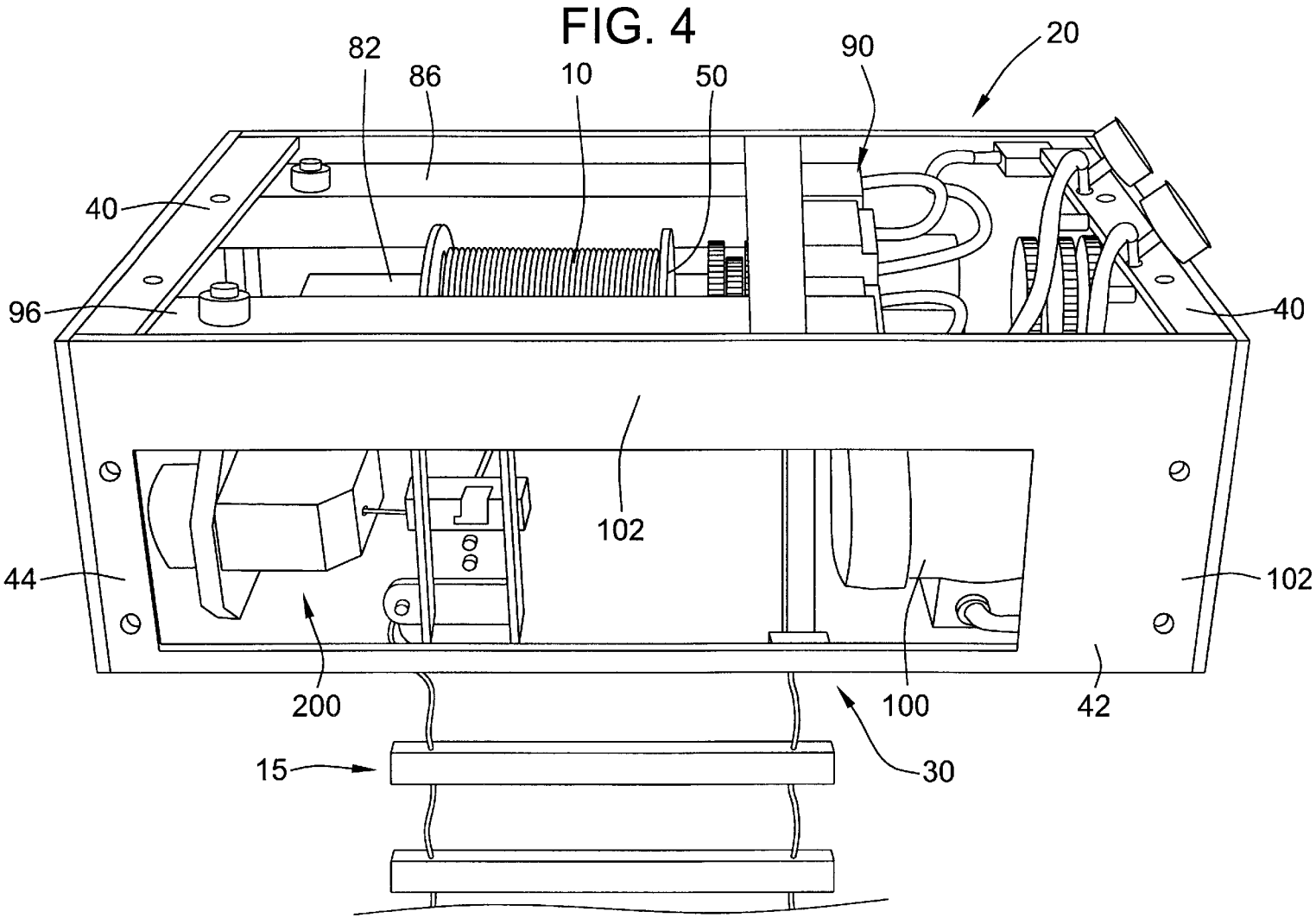
FIG. 4 illustrates a rear perspective view of a controlled descent apparatus according to the present invention.
Figure 5:
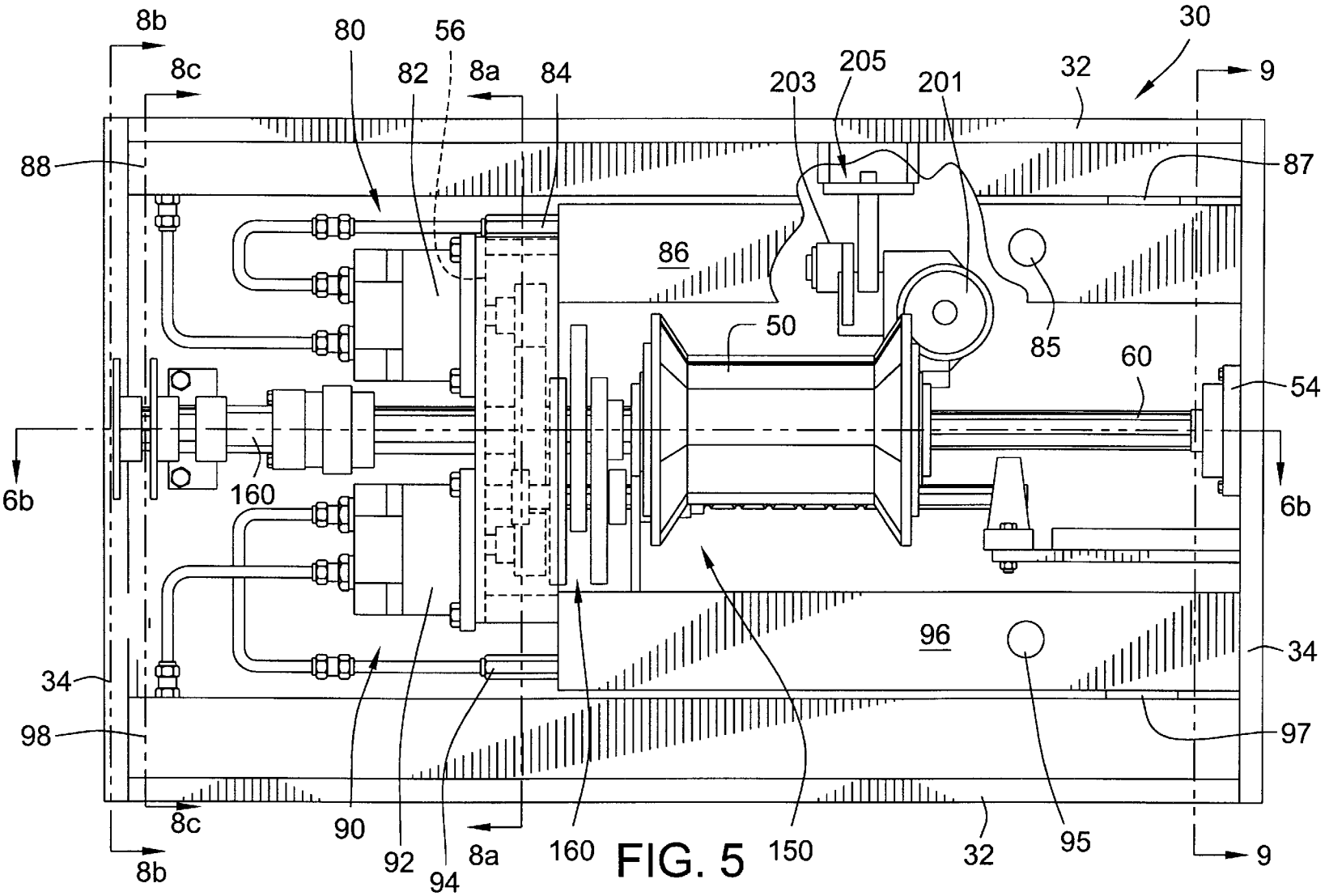
FIG. 5 illustrates a partially cut-away top view of the apparatus of FIG. 4.

As shown in FIGS. 4–6, the various components of the descent apparatus 20 are mounted on a rigid frame 30 made up of four longitudinal frame members 32, four transverse frame members 34 and four vertical frame members 36 (FIG. 6). All of the longitudinal, transverse, and vertical frame members 32, 34, 36 are suitably welded together to form a rectangular box shape. As indicated in FIGS. 1–3, the frame 30 is intended to be mounted on the inside of an exterior wall 22, or on the ceiling 23 of the building above a window 24. This is accomplished by providing mounting plates. As best seen in FIG. 4, a pair of mounting plates 40 extend transversely between the upper longitudinal members 32, the mounting plates including apertures for mounting to the ceiling 23 by screws or threaded rods. Similarly, apertures are provided in a rear plate 102 which defines mounting plate 44 and motor mounting plate 42 for attaching the apparatus 20 to the interior wall 22 of a building. The components of the apparatus are enclosed by a cover (not shown) which attaches to the frame 30 in any suitable manner well known in the art. As shown in FIGS. 3 and 4, a ladder 15 is suitably attached to the frame 30 so that upon release of the arm to its active position as shown in FIG. 3, the user(s) may connect to the free end of the cable 10, typically by way of a body harness (not shown), and then use the ladder 15 to exit the building via window 24 and begin descent.

Figure 5A:
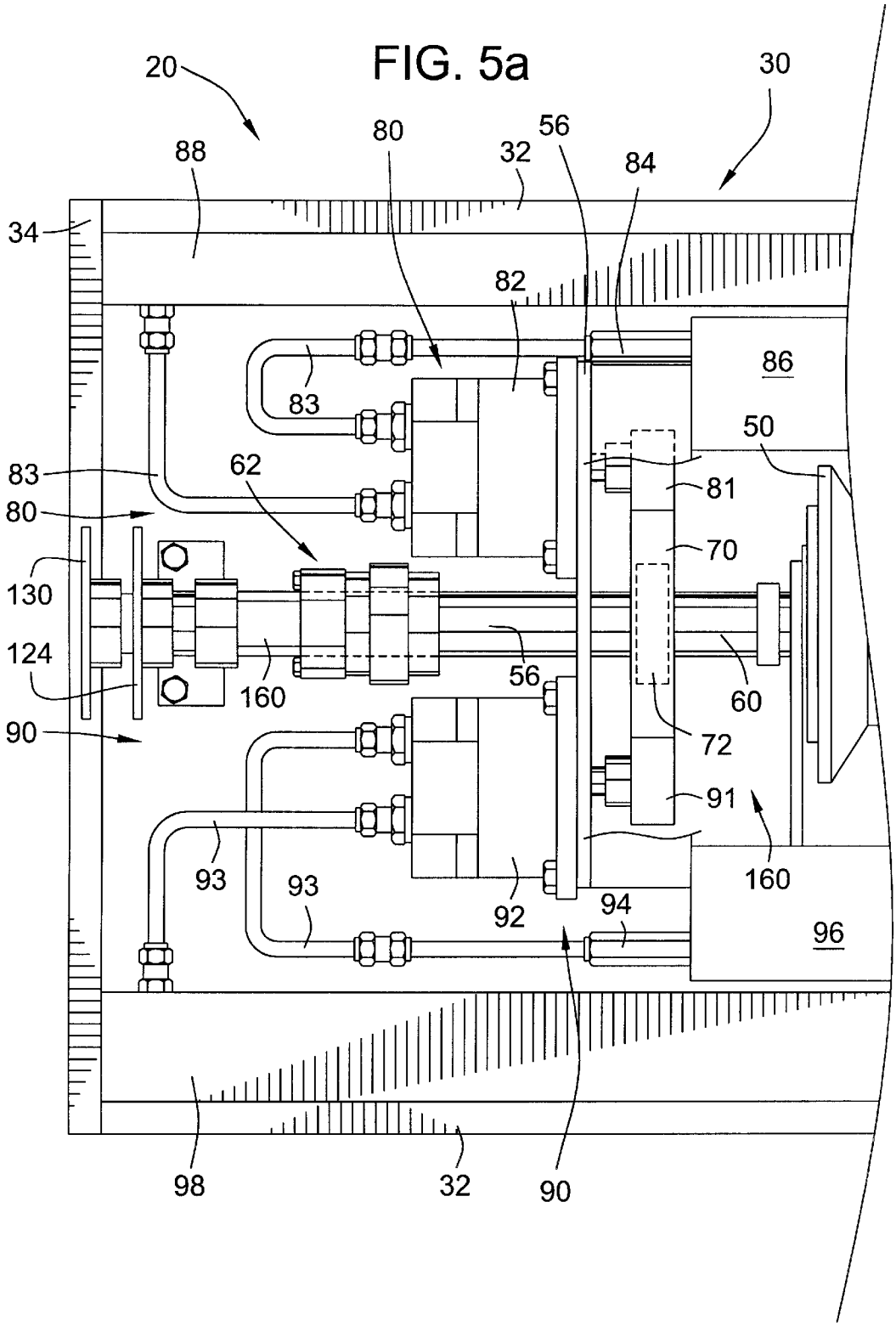
FIGS. 5*a*, 5*b* and 5*c* illustrate sectional views of FIG. 5.
Figure 5B:
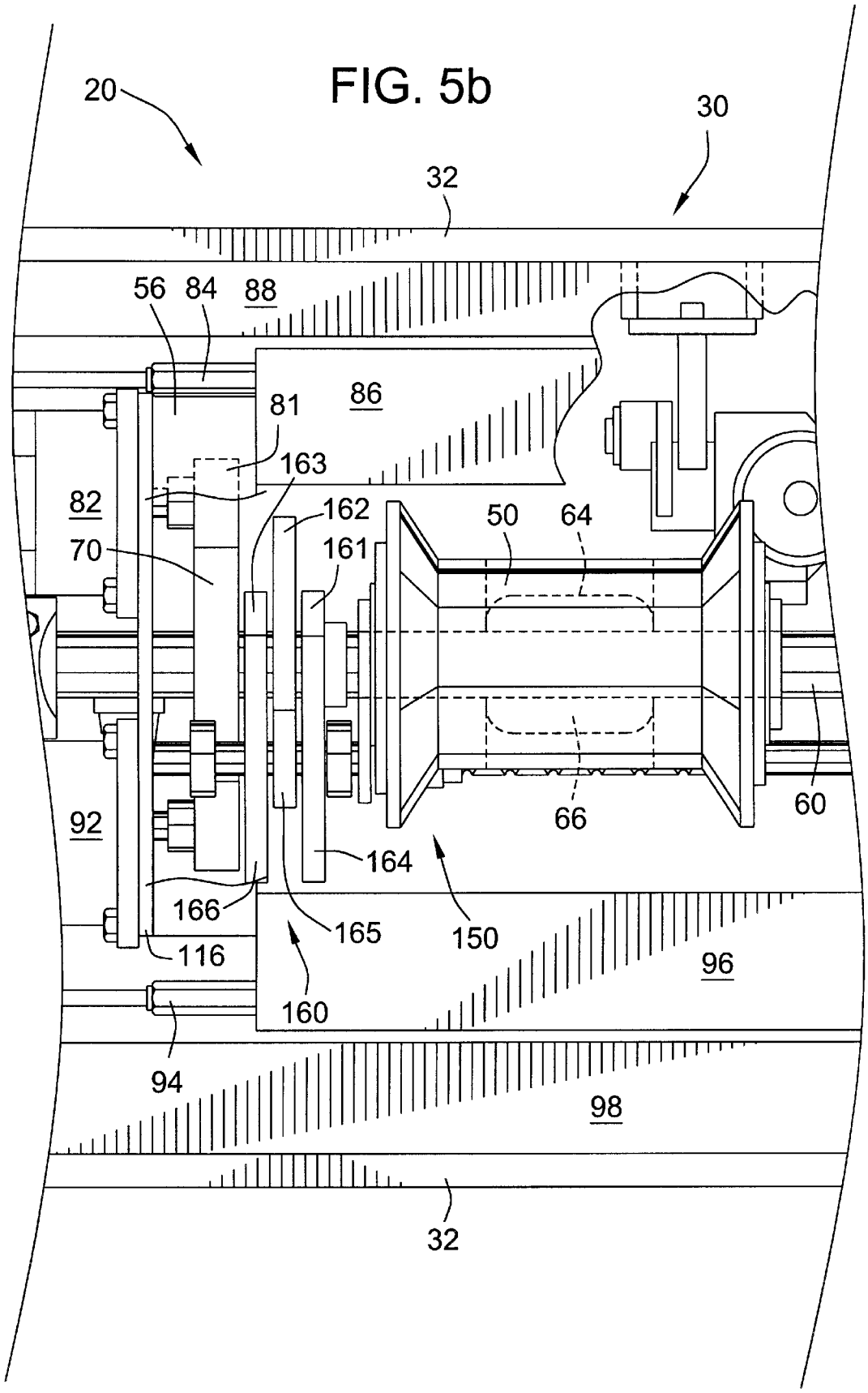
Figure 9:
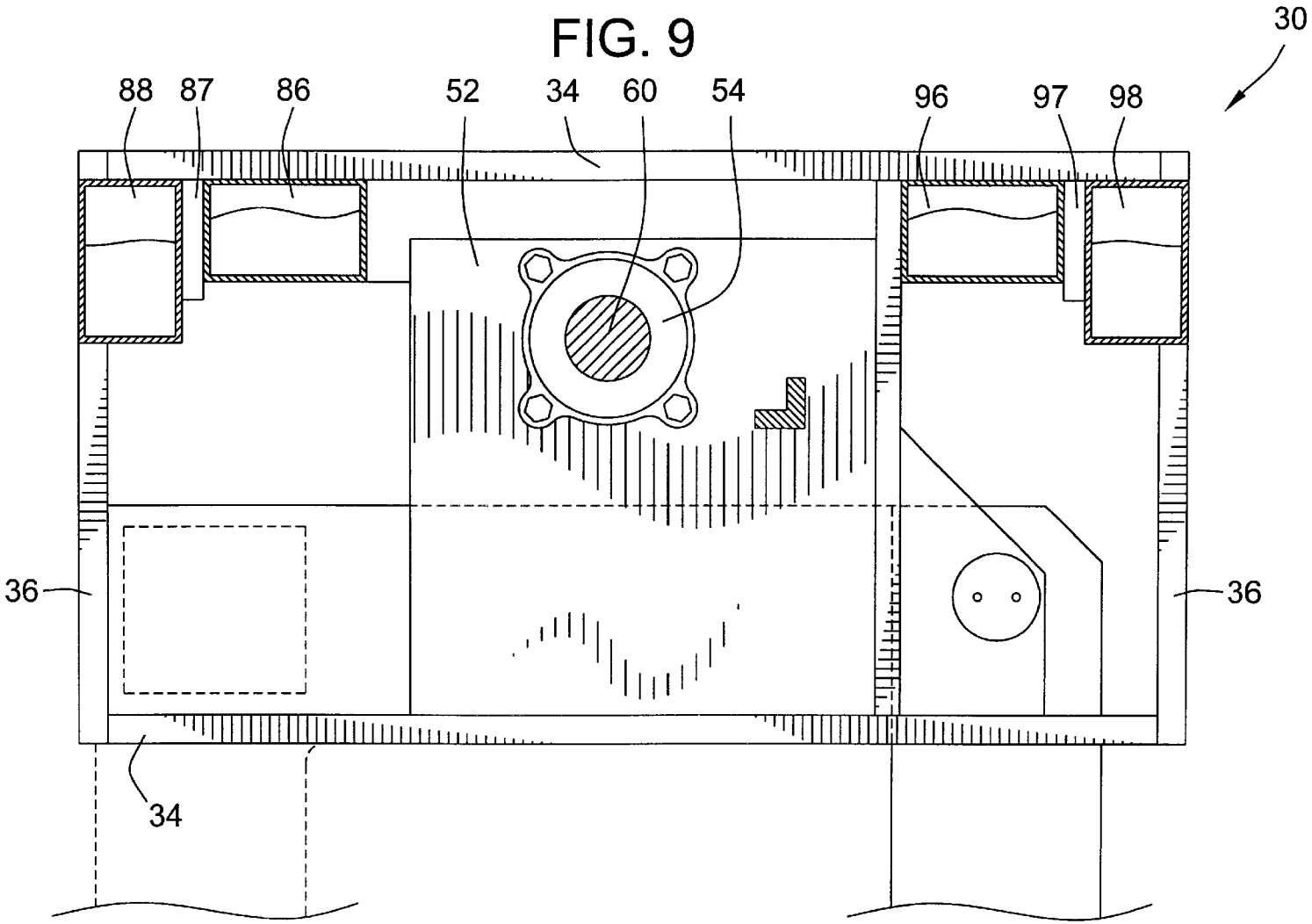
FIG. 9 illustrates a cross-sectional view taken along the line 9 in FIG. 5.

The drum or spool 50 is axial with and carried by a horizontal shaft 60. As best seen in FIG. 9, the frame includes a pivot plate 52 extending vertically between two transverse frame members 34. The shaft 60 has one end journalled in the pivot plate 52 in journalling bearing 54. The other end of the shaft is supported by an L-shaped support plate 56 (FIGS. 6*a* and 6*b*) affixed to the return tanks 86, 96, the plate 56 having a bearing therein for supporting the shaft 60. The shaft 60 projects through plate 56 into one-way clutch 62 which will be described in more detail below (FIG. 5*a*). The spool 50 is slidably and rotatably mounted on the shaft 60 by means of a roller bearing 64 and one-way clutch 66, both of which are attached to the shaft 60. When the drum 50 is being turned in the direction caused by the cable 10 unwinding during a descent (counter-clockwise in FIG. 6*b*) the drum 50 turns the shaft 60 through the one-way clutch 66, but the clutch causes the shaft to be disengaged from the spool when the spool is turned in the opposite direction so that the drum turns freely on the shaft. Such one-way clutches 66 are well known in the art and any such clutch may be used in conjunction with the present invention.

Figure 8A:
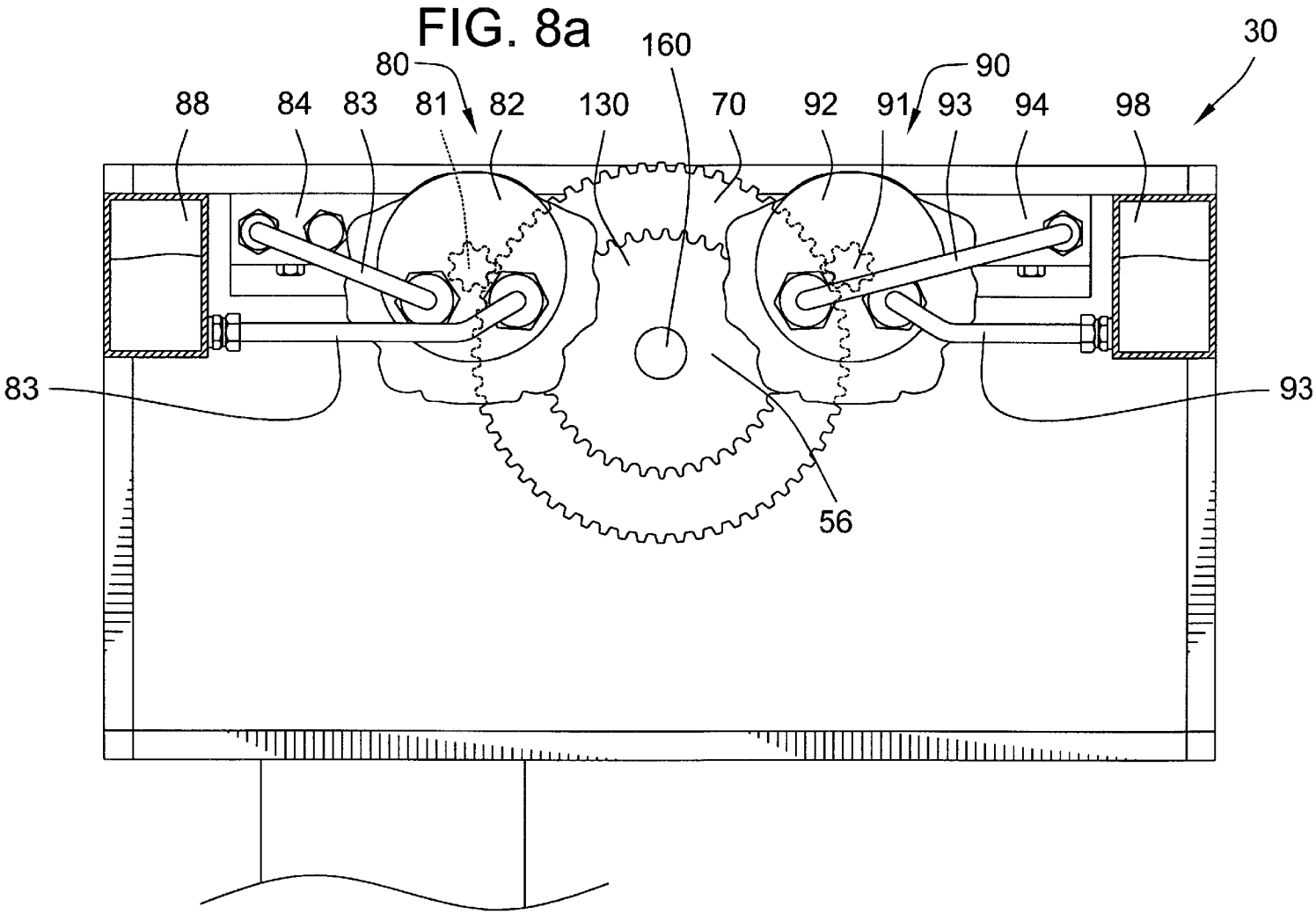
FIGS. 8*a*, 8*b* and 8*c* illustrate cross-sectional views taken along the lines 8*a*, 8*b*, and 8*c* of FIG. 5.
Figure 8B:
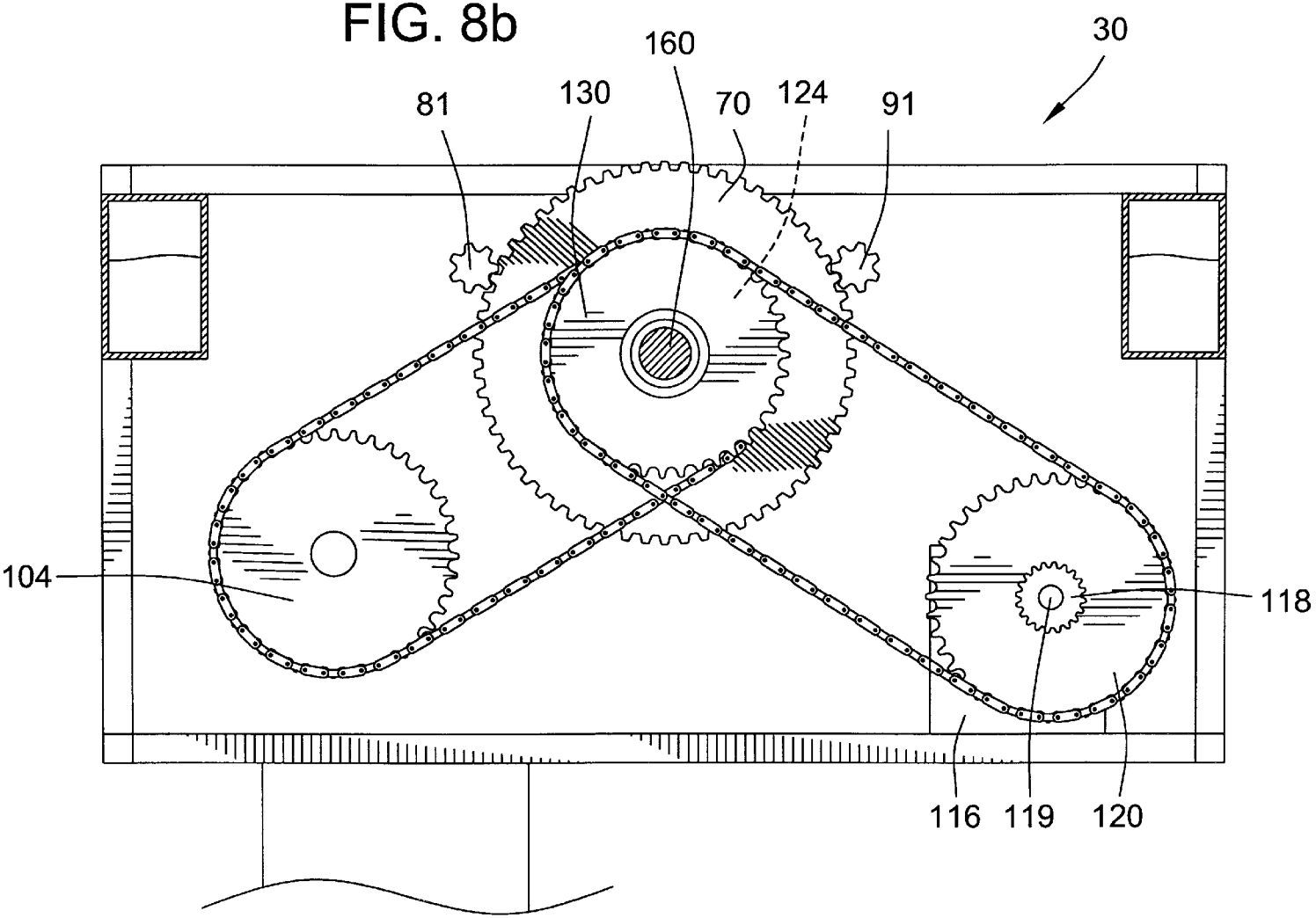
Figure 8C:
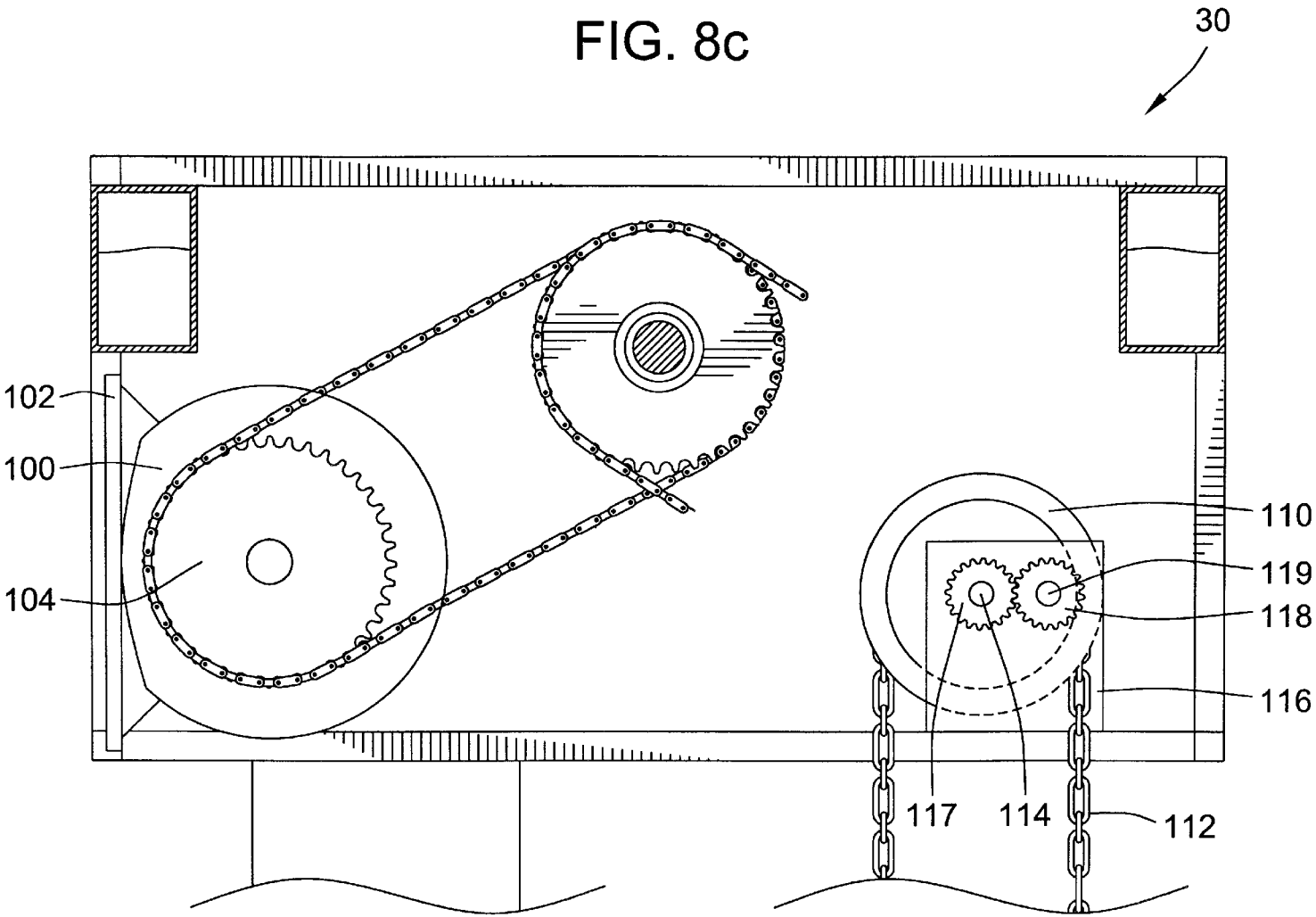

In the preferred embodiment, the means for regulating the rotational speed of the spool in a winding direction includes a primary braking system 80 and a secondary braking system 90. As best seen in FIGS. 5 and 5*a*, a braking gear 70 is rotatably mounted to the shaft 60 via a one-way bearing 72. As cable 10 is drawn from the spool 50 during a descent, the rotating spool drives the main shaft 60 as previously discussed. The braking gear 70 and its one-way bearing 72 are mounted to the shaft 60 so as to be driven by the shaft during descent. The braking gear 70 in turn drives two pumps 82, 92 through their respective gears 81, 91 by meshing with the gears fast on the shafts of the pumps 82, 92, the first pump 82 being connected to the primary hydraulic circuit or braking system 80 (FIG. 8*a*). The second pump 92 is connected within a second hydraulic circuit comprising the secondary braking system 90. The pumps 82, 92 are mounted to the support plate 56 which also supports the shaft 60.

As best seen in FIG.5*a*, the primary braking system 80 includes pump 82, a flow control valve 84, a return reservoir or tank 86, and a supply reservoir or tank 88. Similarly, the secondary braking system 90 includes pump 92, a flow control valve 94, a return tank 96, and a supply tank 98. The hydraulic circuits of the braking systems 80, 90 may also include appropriate filters and drains as desired. It will be noted that all of the return tanks 86, 96 and supply tanks 88, 98 are preferably welded together and to the frame members, or may otherwise be integrally provided therein. This allows the tanks to be used to support other support structures or elements of the descent apparatus, such as by way of the support plate 56.

With reference to FIGS. 5, 5*a–c*, and 8*a*, the supply reservoirs or tanks 88, 98 for the two braking systems 80, 90 are generally rectangular and tubular, and span substantially all of the longitudinal length of the frame 30 in conjunction with longitudinal frame members 32. The supply tanks are fluidically connected to their respective pump via steel tubing 83, 93. The return reservoirs or tanks 86, 96 are located adjacent their respective supply tanks 88, 98 and are fluidically connected thereto via conduits 87, 97.

Figure 5C:
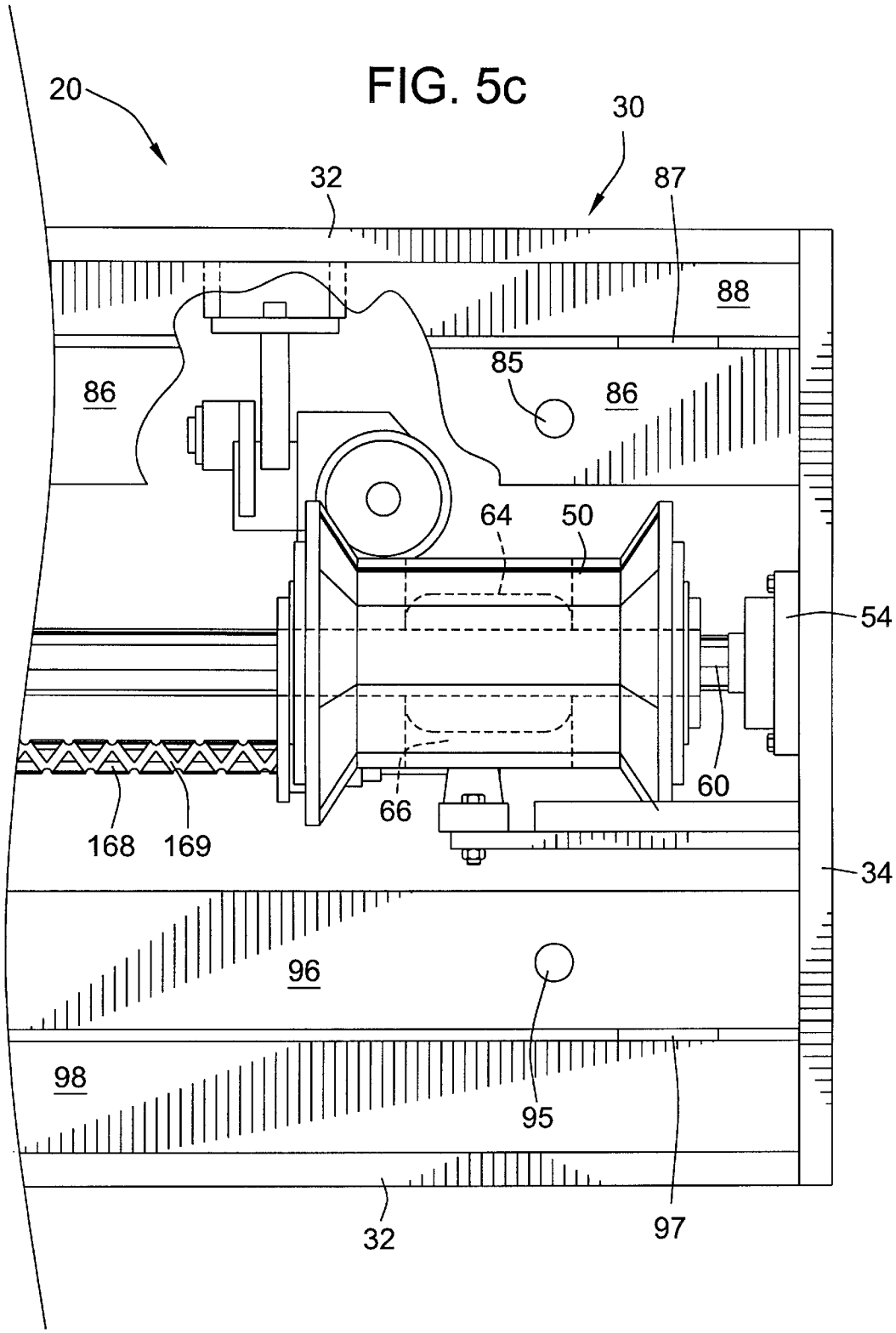

It will be noted that the conduits 87, 97 are located at a longitudinal end opposite the connection between the pumps 82, 92 and supply tanks 88, 98, thereby creating a long flow path from the pump through regulation valves 84, 94, return tanks 86, 96, supply tanks 88, 98 and corresponding tubing 83, 93, as seen in FIG. 5*c*. This long flow path allows the hydraulic fluid to cool before being recirculated through the pumps, reducing the potential for overheating. Furthermore, the return tanks 86, 96 each include a filler or breather 85, 95 which allows access to the interior of the tank for refilling hydraulic fluid or allowing the fluid to breathe and cool further.

Returning to FIG. 5*a*, as the braking gear 70 is driven by the shaft 60 during descent, the pump 82 of the main braking system 80 is driven by virtue of its geared connection to the braking gear. The pump pressurizes fluid from the supply tank 88, pulling the fluid through the pump 82 which then exits via tube 83. The fluid exiting the pump 82 is directed through a regulating or flow control valve 84, which limits the flow rate of hydraulic fluid therethrough. The fluid then exits the regulating valve 84 and is delivered to the return tank 86 via tubing 83. The flow control valve 84 regulates the rate of fuel exiting the pump 82, which in turn limits the rotational speed of the pump's gear 81. Therefore the valve 84 may be manufactured to permit the flow which produces the selected maximum rate of descent. The valve 84 may be an adjustable valve, however in the preferred embodiment valve 84 (and valve 94) are non-adjustable with a pre-selected setting to prevent inadvertent changes or tampering. Because the pump 82 operates as a constant speed for a constant flow, the valve 84 effectively limits the speed of the pump 82 and hence the speed of rotation of the spool 50.

The backup braking system 90 operates much in the same manner as the primary braking system 80. The pump gear 91 fixed to the pump shaft is driven by the braking gear 70 as the shaft 60 rotates during descent. The pump 92 pressurizes fluid from the supply tank 98 which is then pumped through the flow control valve 94. The flow control valve 94 limits the flow rate of hydraulic fluid therethrough, the fluid exiting the valve and delivered to the return tank 96 via tubing 95. Preferably, the flow control valve 94 is set substantially identical to the control valve 84 of the primary braking system 80 to limit the flow and hence speed of the pump 92 to a level and speed corresponding to the main system 80. Thus, both braking systems 80, 90 work in unison to limit the rotation of the drum 50 during descent, and both will operate to back up the other system in the unlikely event it fails. When one braking system 80, 90 is operating alone to control descent, the speed of descent is substantially identical to the speed when both systems are operating, and the lone system 80, 90 will have taken over all braking immediately and very smoothly as little to no speed change has taken place.

However, it will be understood that the flow control valve 94 of the back-up braking system 90 can be designed to limit the flow of hydraulic fluid therethrough to a level slightly higher than the flow control valve 84 of the primary braking system 80. In this case, the pump gear 91 is allowed to rotate slightly faster than the primary system's pump gear, and during normal descent the primary braking system 80 acts on the braking gear 70 to reduce its rate of rotation, while the pump gear 91 of the back-up braking system 90 merely rotates with the braking gear 70 as it has not reached the upper flow limit determined by the flow control valve 94. In the unlikely event that the primary braking system 80 fails, the shaft 60 and braking gear 70 would begin to rotate slightly faster. As the braking gear 70 rotates slightly faster, it will drive the back-up pump 92 slightly harder until the flow limit of the regulating valve 94 is reached. At this point, the back-up braking system 90 would act upon the braking gear 70 to limit the rotation of the shaft 70 and spool 50. As the braking gear 70 is larger than the pump gear 91, a small increase in the rotational speed of the braking gear 70 results in a larger increase of the rotational speed of the pump gear 91, depending on the particular ratio selected. As the flow limit given by the flow control valves 84, 94 may be pre-selected with a high degree of accuracy, the back-up braking system 90 can be set to respond to a small increase in shaft rotational speed almost instantly. Whether the braking systems 80, 90 are set to be identical or slightly different, the back-up braking system 90 may quickly, if not immediately, resume braking duties, providing a very smooth and rapid transition between the primary braking system 80 and the secondary braking system 90.

After a descent, the cable 10 may be rewound on the spool 50 for a second descent and such rewinding may be accomplished by power, if electricity is available under the circumstances, but otherwise by hand. For this purpose, and with reference to FIGS. 6*a–b*, 8*b–c*, an electric motor 100 mounted on a motor mounting plate 42 connected to the frame 30 drives a sprocket 104. The sprocket 104 is coupled to a corresponding sprocket 124 on a rewind shaft 160 (see also FIG. 5). Similarly, for manual rewind a pulley 110 is adapted to be driven by an endless chain 112 engaging and hanging from the pulley 110. The pulley 110 drives a shaft 114 which extends into a gear box 116 housing a pair gears 117, 118. The pulley 110 drives a first gear 117 which in turn drives a second gear 118 affixed via a second shaft 119 to a sprocket 120. The sprocket 120 is operatively connected to a corresponding sprocket 130 supported on the return shaft 160. The use of two gears allows the chain 112 and its pulley 110 to be located away from the wall which the apparatus engages, and allows the portion of the chain loop furthest from the wall and closest to a person to be pulled to rewind the cable. The sprockets 124, 130 are attached adjacent one end of the return shaft 160, while the opposing end of the return shaft 160 is coupled to a one-way clutch 62 which in turn is coupled to the end of main shaft 60 extending through support plate 56. The one-way clutch 62 is disposed such that when the spool 50 and main shaft 60 are rotating during descent (driving the braking gear 70 and pumps 82, 92) the one-way clutch 62 disengages the rewind shaft 160 from the main shaft 60 so that the sprockets 124, 130, motor 100 and pulley 110 do not rotate during descent. However, during rewind, either by power or manually, the one-way clutch 62 operatively connects the rewind shaft 160 to the main shaft 60, such that the latter may be driven by the pulley 110 or motor 100.

The one-way bearing 72 on which the braking gear 70 is mounted prevents the braking gear from rotating during rewind. It will be appreciated by those of skill in the art that both sprocket 124 and sprocket 130 are mounted to the shaft via one-way bearings (not shown). As such, when the motor is driving sprocket 124, which in turn is driving rewind shaft 160, sprocket 130 that is operatively coupled to the pulley 110 does not rotate due to the one-way bearing. Likewise, when the spool 50 is being rewound manually, the sprocket 124 operatively connected to the motor 100 is not driven. When either of the sprockets 124, 130 drive the rewind shaft 160 in the rewind direction, the one-way clutch 62 permits the rewind shaft to drive the main shaft 60.

In order to wind the cable 10 evenly on the spool 50, the spool 50 is traversed back and forth by a conventional winding mechanism 150. As shown in FIGS. 5, 5*b–c*, and 6*a–b*, and best seen in FIG. 6*a*, the winding mechanism 150 is operatively coupled to the main shaft 60 via gear reducing system 160. The gear reduction system 160 includes a first, second and third gear 161, 162, 163 mounted to the main shaft 60 in a fourth, fifth and sixth gear 164, 165, 166 mounted to a winding shaft 168. The gear reduction system 160 drives the winding shaft 168 which includes a diamond shaped track 169 traversing the shaft. A nut 170 surrounds the winding shaft 168 and includes a follower on the internal surface which follows the track or path 164. The nut 170 is held against turning by a yoke 172 which is rigidly attached to the nut 170 and the spool 50. Thus, as the winding shaft 168 rotates, the nut 170 rides in the diamond shape track 169 in the shaft 168 so that the nut travels along the shaft and reverses direction each time it reaches an end of the shaft. As a result, the spool 50 also travels horizontally as it is rigidly connected to the nut 170 via yoke 172. As previously discussed, the spool 50 is adapted to slide horizontally by virtue of roller bearing 64. The winding shaft 168 is journalled at one end to journal bearing 176 supported on the frame 30 by plate supports 177, and at the other end by a bearing formed in support plate 56. As a result, the cable 10 which is being wound on the drum 50 moves back and forth between the ends of the drum and the cable is thereby evenly distributed.

As previously mentioned, a gear reducing mechanism 160 operatively connects the main shaft 60 to the winding shaft 168. The first gear 161 is keyed to the main shaft 60 and drives the fourth gear 164 rotatably supported on the winding shaft 168. The fourth gear 164 is rigidly connected to the fifth gear 165 via screws, wherein the fourth and fifth gear 164, 165 are freely supported on the winding shaft 168 by virtue of bearings (not shown). The fifth gear 165 meshes with the second gear 162 which is rigidly connected to the third gear 163 via screws. The second and third gears 162, 163 are freely rotatable on the main shaft 60 by virtue of bearings (not shown). The third gear 163 is meshed with the sixth gear 166 which is keyed to the winding shaft 168. It will therefore be understood that the first gear 161 is driven by the main shaft 60 and in turn drives the fourth and fifth gears 164, 165 which freely rotate around the winding shaft 168. The fourth and fifth gears 164, 165 drive the second and third gears 162, 163 which also freely rotate around the main shaft 60. Finally, the third gear 163 drives the sixth gear 166, which in turn drives the winding shaft 168. Thus, the winding mechanism 150 is driven by the main shaft 60 regardless of the direction of the spool 50 and whether the cable is wound or unwound.

In accordance with another aspect of the present invention, the arm 200 is constructed in a novel manner so as to be readily and compactly stored on the frame 30 within the cover and still be easily and automatically projected through an opening in the wall such as the window 24 so that it is in active position to guide the cable 10 for a descent. Moreover, the arm 200 is constructed so that the arm will break any pane of glass that may be in the window 24 as the arm moves to its active position. In its more detailed aspects, the invention contemplates an arm 200 which upon activation automatically swings from an inactive to its active position.

To these ends, and with reference to FIGS. 1–3, 6*a* and 7, the arm 200 is made up of an inner section 210 fulcrumed at one end to the frame 30 to swing about a horizontal axis parallel to the wall. The arm also includes an outer section 220 which has one end pivotally connected to the end of the inner section 210 to swing about an axis which extends longitudinally of the inner section 210. Thus, when the arm 200 is stored in its inactive position (FIG. 1), both sections 210, 220 are inside the cover with the inner section 210 horizontal and perpendicular to the wall and the outer section 220 horizontal and perpendicular to the inner section 210. In operation, the arm 200 is activated and the two sections swivel under their own weight about their respective axes. As will be described in more detail herein, the outer section 220 is designed to swivel faster than the inner section 210, such that the outer section 220 swivels and locks to the inner section 210 and the entire arm 220 is swung through the window (FIGS. 1–3) and locked in the active position for descent. At all times, the cable 10 is guided from the drum 50 via pulley 201 pivotally mounted via hinge 203 to support 205 on the frame 30. Pulley 201 constantly guides cable 10 to the arm 200, through which it is fed (FIG. 7) via pulleys 223, 224 to the free end of the outer section 220 so that the cable is immediately ready for descent.

Figure 6A:
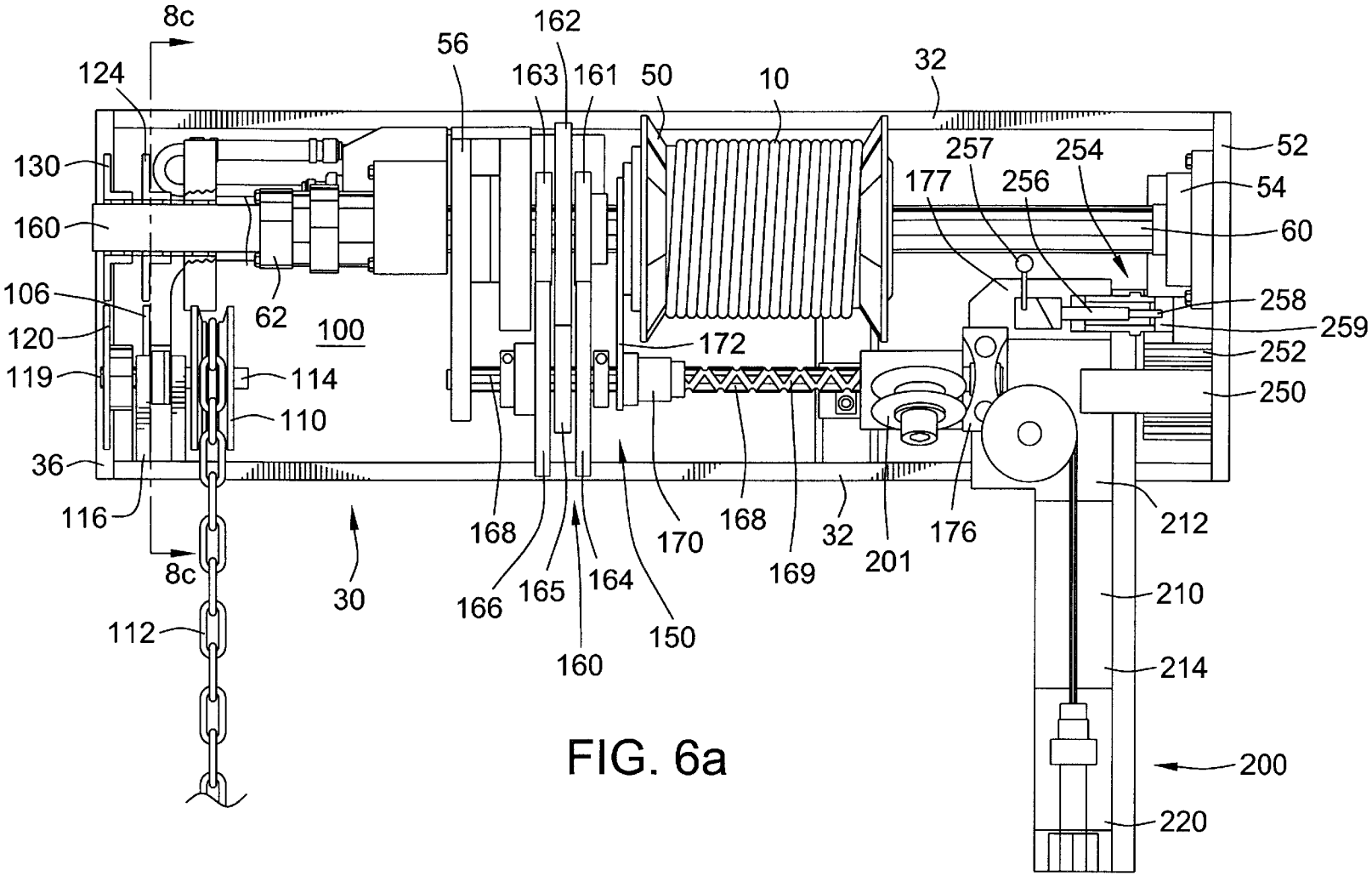
FIGS. 6*a* and 6*b* illustrate a front view and a front cross-sectional view of the apparatus of FIG. 4.
Figure 6B:
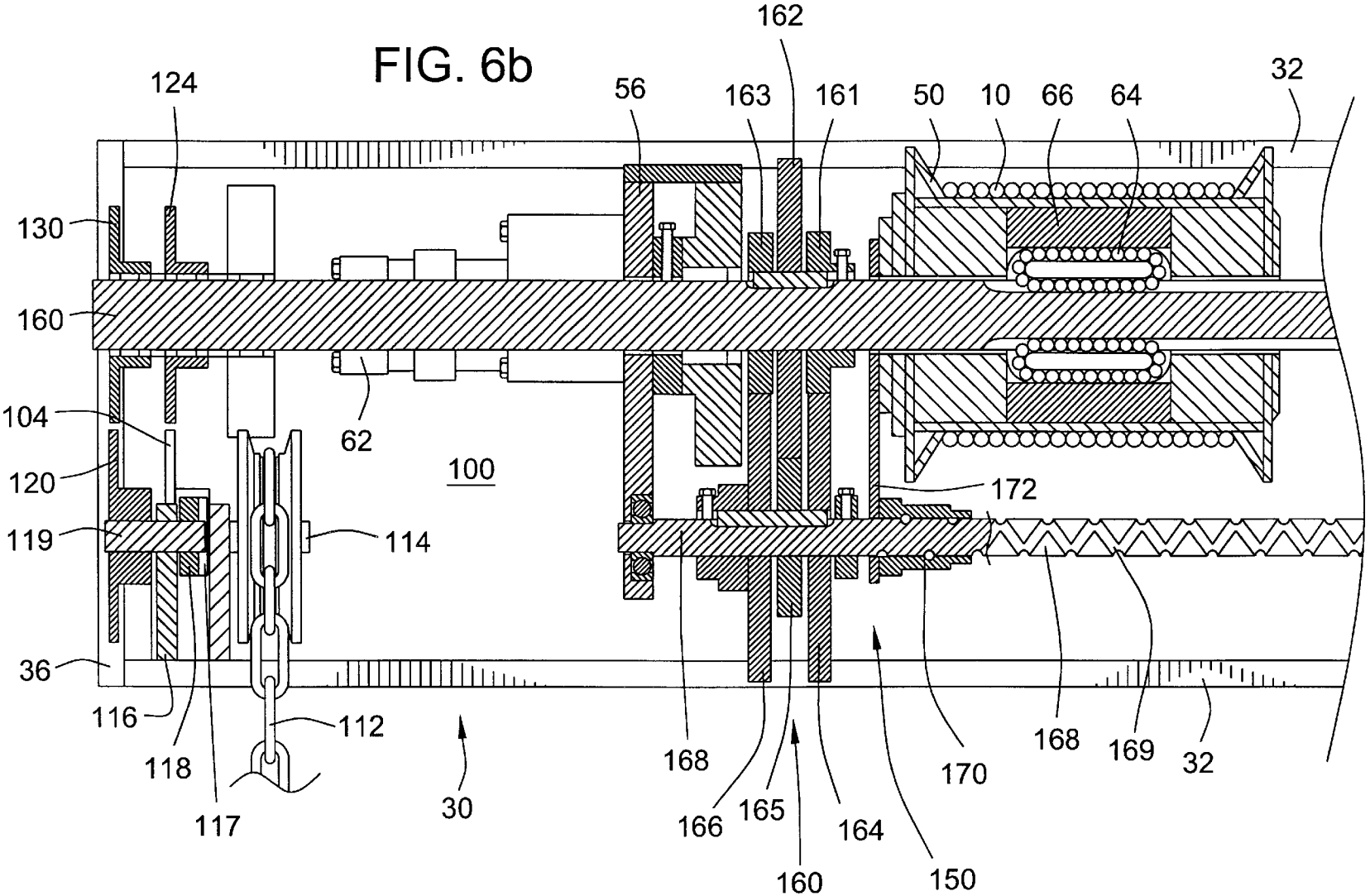
Figure 7:
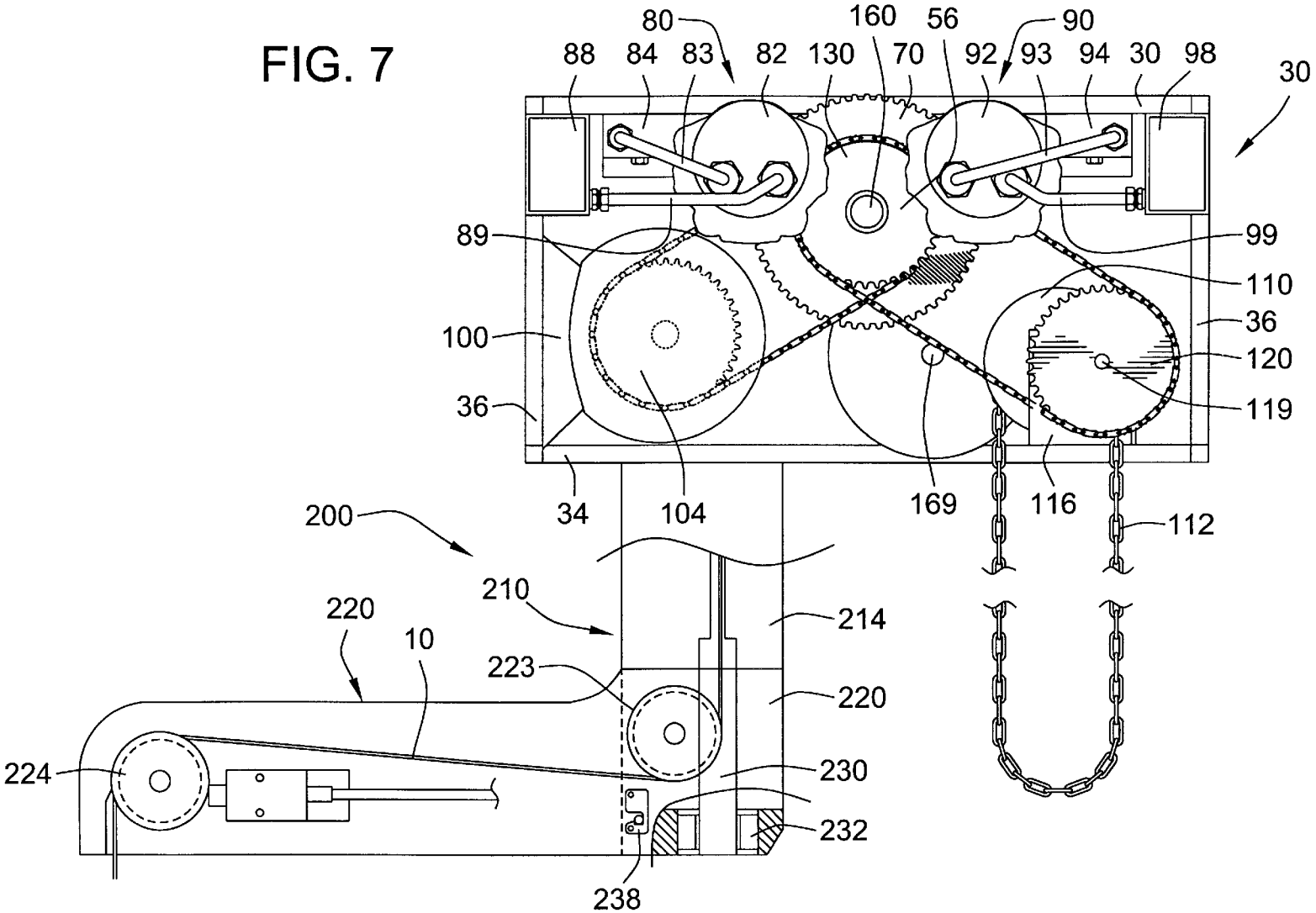
FIG. 7 illustrates a right view of the apparatus of FIG. 4.

In the present instance, as illustrated in FIGS. 6*a* and 7, the pivotal connection of the outer section 220 to the inner section 210 includes a single pin 230 journalled in a cylindrical bearing 232 which is mounted within the inner arm section 210 proximate the outer end 214 thereof. Thus the outer section 220 can swing about the pin 230 from the horizontal stored position through a right angle. The bearing 232 is preferably made of brass and is adjustable to select the frictional force created between the pin 230 and outer section 220 to vary the speed with which the outer arm section 220 swings relative to the inner arm section 210. A latch 240 (FIG. 1) releasably holds the outer section 220 of the arm 200 in its horizontal stored position and, in this instance, the latch is in the form of a vertical rectangular plate pivotally mounted on a bracket to swing about an axis perpendicular to the outer section when the arm is in the stored position. The bracket is secured to the frame and a compression spring acts between the bracket and the back of the latch plate to urge the latter toward the latched position. To release the outer arm section, the latch plate is swung back against the action of the spring via the L-shape of the latch plate and a downward force placed on the latch plate by a rope causes the plate to rotate about a selected pivot point. When the outer section is returned to the stored position, the outer section engages an incline surface on the latch plate and cams the latter back until section is even with the notch at which time the plate swings forward to hold the section.

Another latch 238 secures the outer section 220 of the arm 200 to the inner section 210 when the outer section has swung a full 90° arc. In the preferred embodiment, the latch 238 is a finger (FIG. 7) disposed in a notch on the inner arm and biased to the latching position by a compression spring. As the outer section 220 approaches a full swing arc, the finger engages the inner section 210 and cams the back against the action of the spring until aligned with the finger hole (not shown) in the inner section 210. The finger and enters the hole to fix the outer section 220 to the inner section 210. The finger is swung manually by way of tab against the spring to release the outer section 220 when it is desired to return this section to the stored position.

To support the inner section 210 of the arm 200 for swinging about its horizontal axis, the end portion 212 of the section adjacent the wall is fast on a fixed stub shaft 250 which is mounted to a brass bearing 252 attached to the frame 30. The brass bearing 252 applies friction to the shaft 250 to regulate the speed of rotation of the inner arm section 210 relative to the frame 30. By way of inventive features, the friction induced by the bearing 252 is set to be somewhat higher than the friction between bearing 232 and pin 230 for the outer arm section's rotation. A latch 256 comprises a spring loaded pin 258 which, when aligned (i.e. the active position) enters a corresponding hole in a latch plate 259 fixed to the frame 30. A release handle 257 retracts the pin 258 when it is desired to place the arm 200 in the inactive position.

Accordingly, when the latch 240 is released, both the inner section 210 and outer section 220 are allowed to swivel and swing under their own weight toward the active position. Due to the different frictional forces set via the brass bushings 232, 252, the outer arm section 220 swings to a position locked with the inner arm section 210 faster than the inner arm section 210 swings relative to the frame 30. Then the outer arm and inner arm swing in unison to place the arm 200 in an active position secured by latch 256. Therefore, by merely releasing the latch 240, the entire arm automatically swings from an inactive position to its active position for use in descent. The arm will automatically break any pane of glass disposed in the window opening as the inner arm is swung to its active position. The user then securely connects to the cable 10, typically by putting on a harness or garment attached to the end of the cable, and steps through window while holding the rope and uses the ladder 15 to descend to a position where the cable 10 taught for final descent. As soon as the rope is released, the person begins to descend, unwinding the cable 10 from the drum 50 by virtue of his own weight. As the drum 50 turns during its unwinding, it drives the pump 82 through the shaft 60 and gears 70 and 81. Because the rate of flow of hydraulic fluid through the outlet of the pump 82 is limited by the flow control valve 84 to a preset maximum, the shaft 60 and hence the drum 50 are also limited to a corresponding speed. As a result, the person descends at a maximum rate correlated with the setting of the flow control valve 84. In practice, a descent at the rate of five feet per second has been found to be desirable.

What is claimed is:

1. A controlled descent apparatus comprising:

a frame adapted to be mounted to building adjacent an opening in the wall;

an arm rotatable between a stored position generally within the frame and an active position projecting a free end through the opening in the wall;

a supply of cable stored on a spool rotatably connected to the frame, the cable guided to a pulley proximate the free end of the arm whereby a weight attached to the cable beyond the pulley will descend while drawing cable from the supply;

a hydraulic circuit operatively connected to the spool to control the rate at which the cable is drawn from the supply, the hydraulic circuit including a positive displacement pump mounted on the frame, a first reservoir connected to a pump inlet and a second reservoir connected to a pump outlet, a flow control valve connected to the pump outlet to limit flow of fluid through the outlet to a preselected rate, the first and second reservoirs formed integrally with the frame, the second reservoir having an exit port connected to an entrance port of the first reservoir such that the first and second reservoirs are connected in fluid series; and a predetermined flow path through the first and second reservoirs, the predetermined flow path running in a first direction from the pump outlet through the second reservoir to the exit port and then in a second substantially opposite direction from the entrance port through the first reservoir to the pump inlet.

2. The controlled descent apparatus of claim 1, wherein the first and second reservoirs are connected to convey fluid along a long path from the pump outlet to the pump inlet to cool the fluid.

3. The controlled descent apparatus of claim 1, wherein the first and second reservoirs are elongated and disposed generally parallel with a longitudinal axis of the frame.

4. The controlled descent apparatus of claim 1, wherein the first and second reservoirs are elongated to define first ends and a second ends, the pump operatively connected between the first ends, the first and second reservoirs fluidically connected adjacent the second ends to convey fluid along a long path from the pump outlet to the pump inlet to cool the fluid.

5. The controlled descent apparatus of claim 1, further comprising a second hydraulic circuit operatively connected to the spool and including a second positive displacement pump mounted on the frame, a third reservoir connected to a pump inlet and a fourth reservoir connected to a pump outlet, and a second flow control valve connected to the pump outlet to limit flow through the second hydraulic circuit to a rate substantially identical to the first hydraulic circuit to control the rate at which the cable is drawn from the supply.

6. The controlled descent apparatus of claim 1, further comprising a second hydraulic circuit operatively connected to the spool and including a second positive displacement pump mounted on the frame, a third reservoir connected to a pump inlet and a fourth reservoir connected to a pump outlet, and a second flow control valve connected to the pump outlet to limit flow of fluid through the second circuit to a rate slightly higher than the first hydraulic circuit to control the rate at which the cable is drawn from the supply when the spool turns at a speed faster than permitted by the first hydraulic circuit.

7. The controlled descent apparatus of claim 5, wherein the third and forth reservoirs are integrally formed with the frame.

8. The controlled descent apparatus of claim 1 wherein the first and second reservoirs are spaced apart thereby forming a heat sink.

9. The controlled descent apparatus of claim 1 wherein the first and second reservoirs have respective enclosing sidewalls such that the first and second reservoirs lack any common sidewall to provide a means for dissipating heat.

* * * * *